United States Patent [19]

Roano

[11] 4,120,593

[45] Oct. 17, 1978

[54] LINE-SPACING SYSTEM FOR PRINTING OFFICE MACHINES

[75] Inventor: Domenico Roano, Parella, Italy

[73] Assignee: Ing. C. Olivetti & C., S.p.A., Ivrea, Italy

[21] Appl. No.: 697,180

[22] Filed: Jun. 17, 1976

[30] Foreign Application Priority Data

Jun. 23, 1975 [IT] Italy ..... 68607 A/75

[51] Int. Cl.[2] ..... B41J 19/90

[52] U.S. Cl. ..... 400/549; 400/568; 400/314

[58] Field of Search ..... 197/65, 66, 67, 68, 197/92, 94, 96, 114, 120, 193

[56] References Cited

U.S. PATENT DOCUMENTS

| | | | |
|---|---|---|---|
| 1,143,404 | 6/1915 | Kennedy | 197/66 |
| 1,677,210 | 7/1928 | Rose | 197/193 |
| 1,757,516 | 5/1930 | Degener | 197/114 R |
| 1,955,614 | 4/1934 | Thompson et al. | 197/94 X |
| 2,104,007 | 1/1938 | Bower | 197/66 |
| 2,262,676 | 11/1941 | Helmond | 197/120 X |
| 2,904,158 | 9/1959 | Hess | 197/66 |
| 2,919,006 | 12/1959 | Hess et al. | 197/66 |
| 2,958,407 | 11/1960 | Hess | 197/66 |
| 3,394,791 | 7/1968 | Mason | 197/120 X |
| 3,428,160 | 2/1969 | Barkdoll | 197/120 X |
| 3,643,775 | 2/1972 | Kittel et al. | 197/120 X |
| 3,700,088 | 10/1972 | Kunst | 197/120 |
| 3,759,361 | 9/1973 | Link | 197/120 X |

*Primary Examiner*—Ernest T. Wright, Jr.

[57] ABSTRACT

A printing office machine of the type having a carriage, a controllable line spacing mechanism and a controllable carriage return mechanism for returning the carriage to the beginning of the printing line with a manually actuatable control actuated by a first key for enabling both the line spacing mechanism and the carriage return mechanism to effect both the line spacing and the return of the carriage to the beginning of the printing line. A manually actuatable stop device, actuated by a second key, is provided for preventing the movement of the carriage to override the carriage return mechanism to effect the line spacing of the carriage without the return of the carriage to the beginning of the printing line.

6 Claims, 4 Drawing Figures

LINE-SPACING SYSTEM FOR PRINTING OFFICE MACHINES

BACKGROUND OF THE INVENTION

The present invention relates to a line-spacing system for a typewriter or other printing office machine, adapted to operate without return of the carriage to the beginning of the printing line in a machine wherein a single control device actuates a line-spacing mechanism of the machine and effects return of the carriage to the beginning of the print line as defined by a left-hand margin stop.

Line-spacing systems for office machines are known wherein the line-spacing mechanism of the platen is controlled by a lever disposed at one end of the carriage and connected to one end of a belt which can be wound on a reel controlled by a corresponding return-to-the-beginning clutch. Upon the actuation of the return-to-the-beginning clutch and the escapement tooth being withdrawn from the rack, the line-spacing control lever is actuated for the rotation of the platen and, thereafter, the carriage is shifted to its left-hand margin. The clutch, therefore, acts as a single control for both the line-spacing and the return-to-beginning operations. The margin stop then produces the reopening or disengagement of the clutch, the re-engagement of the escapement tooth and the return of the line-spacing lever in the initial position of the carriage. Though these systems are fairly simple and reliable, they cannot be used to effect line-spacing without returning to the beginning of the printing line.

A system for line-spacing without return of the carriage to the beginning of the printing line is known wherein the line-spacing control is achieved by actuating an auxiliary electric motor connected through a toothed belt and two gears to the platen of the machine. This system requires the use of a second electric motor and is, therefore, costly.

A second system for line-spacing without return of the carriage to the beginning of the printing line is known wherein the electric motor of the machine produces the rotation of a cam in the path of which a corresponding lever is positioned upon depression of the line-spacing key. The lever is thus shifted and, through the medium of a vertical hook supported by the frame of the machine, causes a transmission shaft disposed on the carriage parallel to the platen to rotate. The shaft actuates the corresponding line-spacing mechanism via a connecting rod. The return to the beginning of the printing line which is controlled by the same machine motor, also operates a line-spacing mechanism with return to the beginning, of the type already described. This line-spacing system without return to the beginning, which is added to that associated with return to the beginning, is therefore rather costly and complicated.

A third line-spacing system is known wherein a cable fixed to one end of the carriage is stretched over the entire length of the carriage and winds around a pulley fixed at the other end of the carriage. The cable passes between two rollers, mounted on a Y-shaped arm fixed to the frame of the machine, and between a roller mounted on an actuator disposed between the two rollers on the arm. By acting on a key connected to the actuator, the cable is tensioned and rotates a lever on which is pivoted a pawl adapted to engage a ratchet wheel on the platen. With this system, there is the disadvantage that the cable slackens with use and therefore line-spacing control no longer conforms with the desired amount. The dimensions of the Y-shaped arm require a carriage of dimensions larger than those of the platen and, finally, in this system, there is also necessary a mechanism for return to the beginning and for line-spacing with return to the beginning of the printing line which is independent of the above-mentioned system.

SUMMARY OF THE INVENTION

The object of the present invention is, therefore, to provide a line-spacing system operative without the return of the carriage to the beginning of the printing line in a machine which uses a single control for the mechanisms for line-spacing and for carriage return or return of the carriage to the beginning of the printing line and which is simple, of relatively small cost and permits precise line-spacing control in any position whatsoever along the entire printing line.

These and other objects are attained in a printing office machine of the type having a carriage, a controllable line spacing mechanism and a controllable carriage return mechanism for returning the carriage to the beginning of the printing line. Manually actuatable control means are provided for enabling both the line spacing mechanism and the carriage return mechanism and means for manually actuating said control means to effect both the line spacing and the return of the carriage to the beginning of the printing line. Also provided are manually actuable stop means for preventing the movement of the carriage to override the carriage return mechanism and means for manually actuating both the control means and the stop means to effect the line spacing of the carriage without the return of the carriage to the beginning of the printing line.

BRIEF DESCRIPTION OF THE DRAWING

The invention will be described in more detail, by way of example, with reference to the accompanying drawing in which.

DETAILED DESCRIPTION OF THE PREFERRED EMBODIMENT

Figure 1:
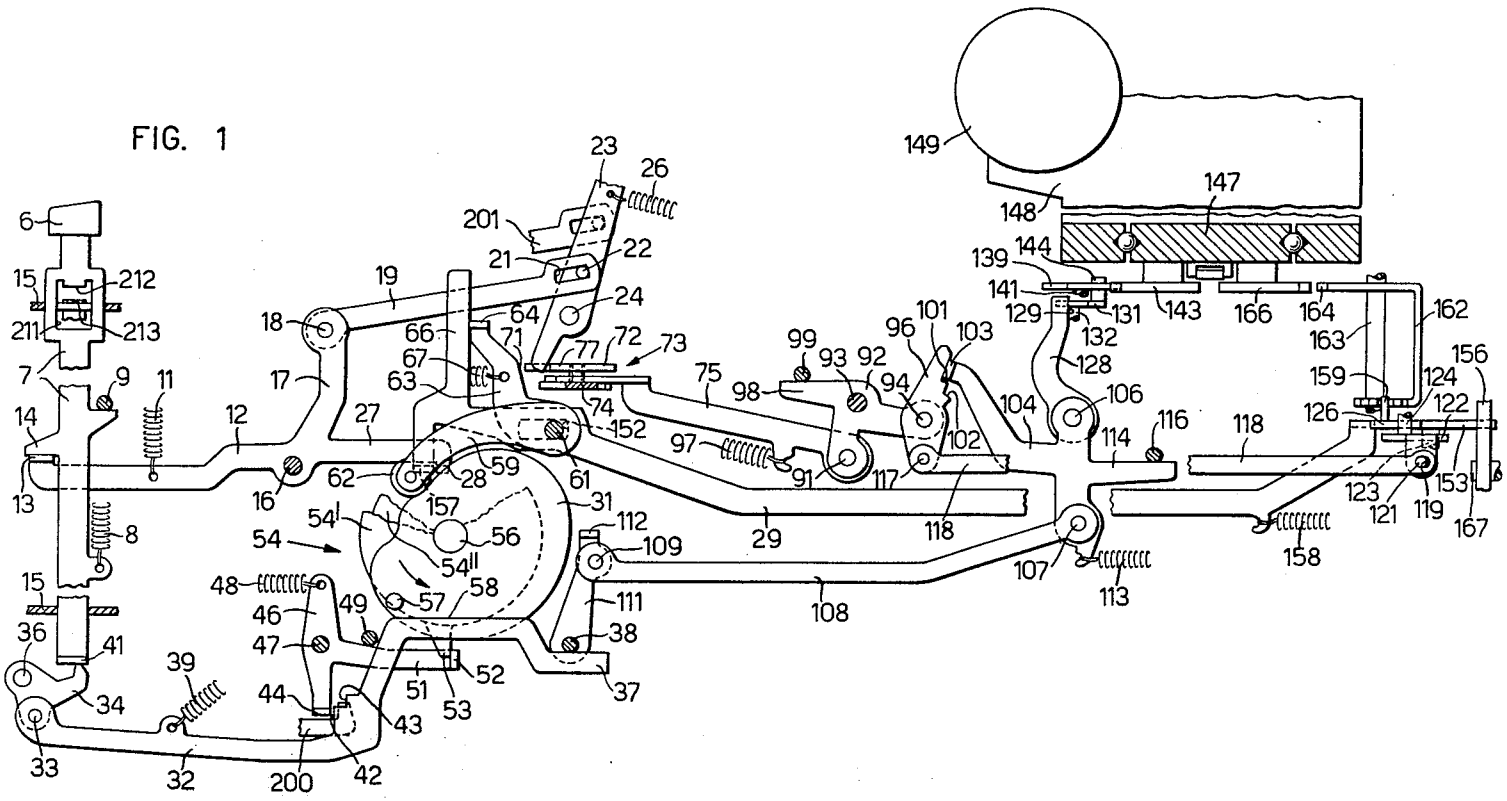
FIG. 1 is a partial longitudinal view of a line spacing system embodying the invention.

Referring to FIG. 1, the line-spacing system without return of the carriage to the beginning of the printing line is applied here to a typewriter and includes a manually operated key 6 having shank 7 slidable vertically in the frame 15 of the machine and normally kept raised against fixed stop 9 by the action of spring 8. Spring 11 normally holds release lever 12 arrested by means of lug 13 bearing against projection 14 of the shank 7.

The release lever 12 can turn on spindle 16 and has an arm 17 connected by means of pin 18 to one end of tie rod 19 which has slot 21 at its other end. In this slot 21 there is seated pin 22 of lever 23 which is mounted to turn on spindle 24 and, under the action of spring 26, is kept turned clockwise, arrested with the pin 22 against the end of the slot 21. The release lever 12 moreover comprises a second arm 27 terminating in an L-shaped shoulder or hook element 28 disposed in front of stop member 29 controlled in turn by cam 31.

The shank 7 of the key 6 is provided with lug 41 cooperating with lever 34 pivoting on spindle 36 and connected by means of pin 33 to one end of slider 32. Under the action of spring 39, this slider 32 is normally kept raised and arrested with end 37 thereof against shaft 38 and so that the lever 34 is arrested against the lug 41 of the shank 7. The slider 32, in turn, has two vertical shoulders 42 and 43 adjacent one another and configured to co-operate selectively with lug 44 of stop element 46 which is mounted to turn on spindle 47 and is normally arrested under the action of spring 48 against fixed stop 49. The stop element 46 moreover includes an arm 51 having lug 52 configured to arrest control tooth or dog 53 of service clutch 54.

The clutch 54 is a clutch of known construction (as described in U.S. Pat. No. 3,338,368 and therefore not shown in detail in the drawing) having a driven part 54' fixed to the cam 31 and a driving part 54" fixed to driving shaft 56. When the tooth 53 is arrested the driven part 54' is arrested, but the driven part 54" rotates with the driving shaft 56 when the tooth 53 is released. Fixed on the cam 31 is pin 57 configured to co-operate with straight portion 58 of the slider 32 in an operative stage, as will be described hereinafter. Moreover, the cam 31 acts against roller 62 on cam-following lever 59 fixed to spindle 61. On this spindle 61 there is fixed a second lever 63 which is pulled by spring 67 holding the roller 62 arrested against the cam 31 and is moreover provided with lug 64 which normally co-operates with arm 66 of the stop member 29.

The lever 63 has an inclined rear edge 71 which is configured to co-operate in an operative stage with cam device 72 of control means 73. The control means 73 (FIG. 2) includes lever 74 and connecting rod 75. The cam device 72 is pivoted on pin 76 of the lever 74, has projection 77 configured to co-operate with the end of the lever 23 (FIG. 1) and is normally arrested against stop 78 (FIG. 2) of the lever 74 under the action of spring 79.

The lever 74 is pivoted on pin 81 and operates, by means of arm 82, control lever 80 of friction clutch 83 for effecting line-spacing and return of the carriage 148 of the machine to the beginning of the printing line. The friction clutch 83 is a clutch of known construction (as described in the U.S. Pat. No. 3,338,368, and therefore is not shown in detail in the drawing) and comprises a driving part which is constituted by disc 87 keyed on the shaft 56 and the driven part 84 is rotatable idly on the driving shaft 56. A friction ring 86 of the part 84 is normally held disengaged from the disc 87 as described in the above-cited U.S. patent.

The connecting rod 75 of the control means 73 is pivoted at one end on pin 89 of the lever 74 and at the other end on pin 91 of lever 92 (FIG. 1); the lever 92 is mounted to turn on spindle 93. Spring 97 normally keeps the connecting rod 75 biased forward towards the key 6, so that arm 98 of the lever 92 is arrested against fixed stop 99 and the lever 74 is kept turned counterclockwise in FIG. 2.

The lever 92 is connected by means of pin 94 to stepped lever 96 which has two horizontal steps or shoulders 101 and 102 configured to co-operate selectively with lug 103 of disengaging device 104. The device 104 is constituted by a lever fixed to spindle 106 and is connected by means of pin 107 to connecting rod 108 connected in turn via pin 109 to clutch control lever 111 rotatable on the shaft 38 and provided with lug 112 configured to co-operate with the control tooth 53 of the clutch 54 during a working stage. Spring 113 normally holds the disengaging device 104 turned counterclockwise, arrested with arm 114 against fixed stop 116.

The stepped lever 96 is connected by pin 117 to one end of connecting rod 118 having at its other end slot 119 engaged by pin 121 of cam element 122. The cam element 122 is mounted to turn on spindle 123 (FIG. 2) and co-operates by means of pin 124 with inclined surface 126 of the stop member 29. Spring 127 normally holds the cam element 122 turned clockwise with the pin 121 arrested against the end of the slot 119, whereby the connecting rod 118 keeps the stepped lever 96 turned clockwise, the stepped lever 96 being arrested against the lug 103 of the disengaging device 104.

The disengaging device 104 further comprises arm 128 (FIG. 1) fixed to the spindle 106 and having end 129 configured to co-operate with escapement control lever 131. The lever 131 (FIG. 2) is pivoted in turn on pin 132 of movable support 133 slidable by means of slot 134 on pin 136. The escapement control lever 131 is kept turned clockwise against the end 129 of the arm 128 under the action of spring 138. Escapement pawl or tooth 139 is pivoted on pin 141 of the movable support 133 and, under the action of spring 142, engages a space in rack 143.

The rack 143 is fixed to movable guide 147 of carriage 148 (FIG. 1) on which is mounted a conventional platen 149. An assembly constituted by the escapement spring 151 (FIG. 2) known per se and connected to the movable guide 147 constantly pulls the carriage 148 (FIG. 1) to the left (upwards in FIG. 2) and normally keeps the movable support 133 (FIG. 2) arrested with the right-hand end of the slot 134 against the pin 136, in opposition to the action of rebound-preventing spring 137, in a manner known per se. Finally, the escapement control lever 131 has lug 144 configured to co-operate with shoulder 146 of the escapement tooth 139.

The stop member 29 comprises a slider slidable longitudinally of the machine and guided by means of slot 152 (FIG. 1) on the spindle 61 and by means of two lugs 153 (FIG. 2) in slots 154 of movable element 156. The slider 29 includes lug 157 configured to co-operate with the L-shaped shoulder 28 (FIG. 1) of the release lever 12 to be arrested when a cycle of return of the carriage 148 to the beginning is started. A spring 158 keeps the slider 29 normally arrested with the arm 66 against the lug 64 of the lever 63. The slider 29 moreover includes lug 159 trapped in notch 161 (FIG. 2) of pawl member 162 which can pivot in turn on spindle 163 fixed to the movable element 156 and has a tooth 164 configured to engage as a detent in a space of a second rack 166 fixed to the movable guide 147.

The movable element 156 is formed by a plate which is slidable parallel to the carriage 148 (FIG. 1) for a predetermined distance defined by pin 167 (FIG. 2) engaged in slot 168. A spring 169 normally keeps the movable element 156 shifted to the left (upwards in FIG. 2) and arrested with the end of the slot 168 against the pin 167.

The driven part 84 of the clutch 83 comprises a pulley connected to the lever 80 and on which band 171 is wound. The band 171 is guided by two pulleys 172 and is fixed by its end 173 (FIG. 3) to line-spacing mechanisms 174.

The line-spacing mechanism 174 comprises lever 176 which is mounted to turn on spindle 177 and has one end connected to the end 173 of the band 171 and the other end connected by slot 178 to pin 179 of bell-crank lever 181. The bell-crank lever 181 can pivot on spindle 182 and is connected by means of tie rod 183 to arm 184 of bail 186 pivoting on spindle 187. Spring 188 normally keeps the bail 186 turned clockwise and, by means of the tie rod 183 and the levers 181 and 176, the bail 186 keeps the band 171 taut. The arm 184 of the bail 186 bears pin 189 on which pivots pawl 191 configured to engage ratchet wheel 192 fixed to the platen 149. The spring 188 moreover keeps the pawl 191 counter-clockwise so that it is arrested against pin 193 which is movable in a manner known per se to different positions to vary the stroke of the pawl 191. Finally, the line-spacing mechanism 174 comprises block 194 co-operating with the pawl 191 during a line-spacing cycle, and spring 196 which normally keeps locating element 197 bearing on the ratchet wheel 192.

Upon the depression of the key 6 (FIG. 1), the release lever 12 is turned counter-clockwise and positions its L-shaped shoulder 28 out of the path of the lug 157 of the slider 29 and, by means of the tie rod 19, causes the lever 23 to turn counter-clockwise. The lever 23 engages the projection 77 and causes the cam device 72 to turn counter-clockwise (FIG. 2), disposing it in the path of the lever 63. Simultaneously with the rotation of the release lever 12, the lever 34 (FIG. 1) is turned clockwise by means of the lug 41 and, pulling the slider 32 forward in opposition to the action of the corresponding spring 39, engages the lug 44 with the shoulder 42, causing the stop element 46 to turn clockwise. The lug 52 then releases the control tooth 53 of the service clutch 54, which is thus closed or engaged and begins to rotate counter-clockwise together with the cam 31.

After a rotation of the cam 31 (FIG. 1) through about 15°, the pin 57 engages the straight portion 58 of the slider 32, cuasing the slider 32 to descend in opposition to the action of the spring 39. The shoulder 42 ceases its engagement with the lug 44, as a result of which the spring 48 brings the stop element 46 back into the rest position in which it is arrested against the stop 49 and has its lug 52 in the path of the control tooth 53 even if the key 6 is kept depressed.

The cam-following lever 59 is now turned clockwise together with the spindle 61 and the lever 63 in opposition to the action of the spring 67. The lug 64 moves to the right in FIG. 1 and the slider 29 can therefore slide longitudinally in the same direction under the action of the spring 158. The slider 29, in turn, causes the pawl member 162 (FIG. 2) to turn counter-clockwise and, by means of the tooth 164, it engages a space of the rack 166, arresting the carriage 148 (FIG. 1) in the position in which it was upon the depression of the key 6. The tooth 164 is disposed in correspondence with the printing point (not shown in the drawing) and therefore the carriage 148 can be arrested in any position along the printing line without any restriction. At the same time, the slider 29 engages the pin 124 with the inclined surface 126 (FIG. 2), causing the cam element 122 to turn counter-clockwise in opposition to the action of the spring 127. By means of the pin 121, the cam element 122 causes the connecting rod 118 to shift and this, in turn, causes the stepped lever 96 to turn counter-clockwise. The lever 96 (FIG. 1) ceases its engagement with the lug 103 and is disposed with the shoulder 102 below the lug 103.

The lever 63, turned clockwise as noted above, engages the cam device 72 with the inclined edge 71, causing the lever 74 (FIG. 2) to turn clockwise and by means of the arm 82 the lever shifts the control lever 80 of the friction clutch 83 and the band-pulling pulley 84, bringing the friction ring 86 into contact with the disc 87. The pulley 84 thus begins to rotate with the disc 87, and begins to wind up a small length of the band 171. The connecting rod 75 is moreover shifted rearward in opposition to the action of the spring 97. (FIG. 1) and causes the lever 92 to turn counter-clockwise and thus raise the stepped lever 96. The shoulder 102 then engages the lug 103, causing the disengaging device 104 to turn clockwise in opposition to the action of the spring 113. In turn, by means of the arm 128, the device 104 (FIG. 2) causes the escapement control lever 131 to turn counter-clockwise, this lever 131 engaging the shoulder 146 by means of the lug 144 and disengaging the escapement tooth 139 partially from the space in the rack 143 in which it is engaged.

Figures 2, 3:
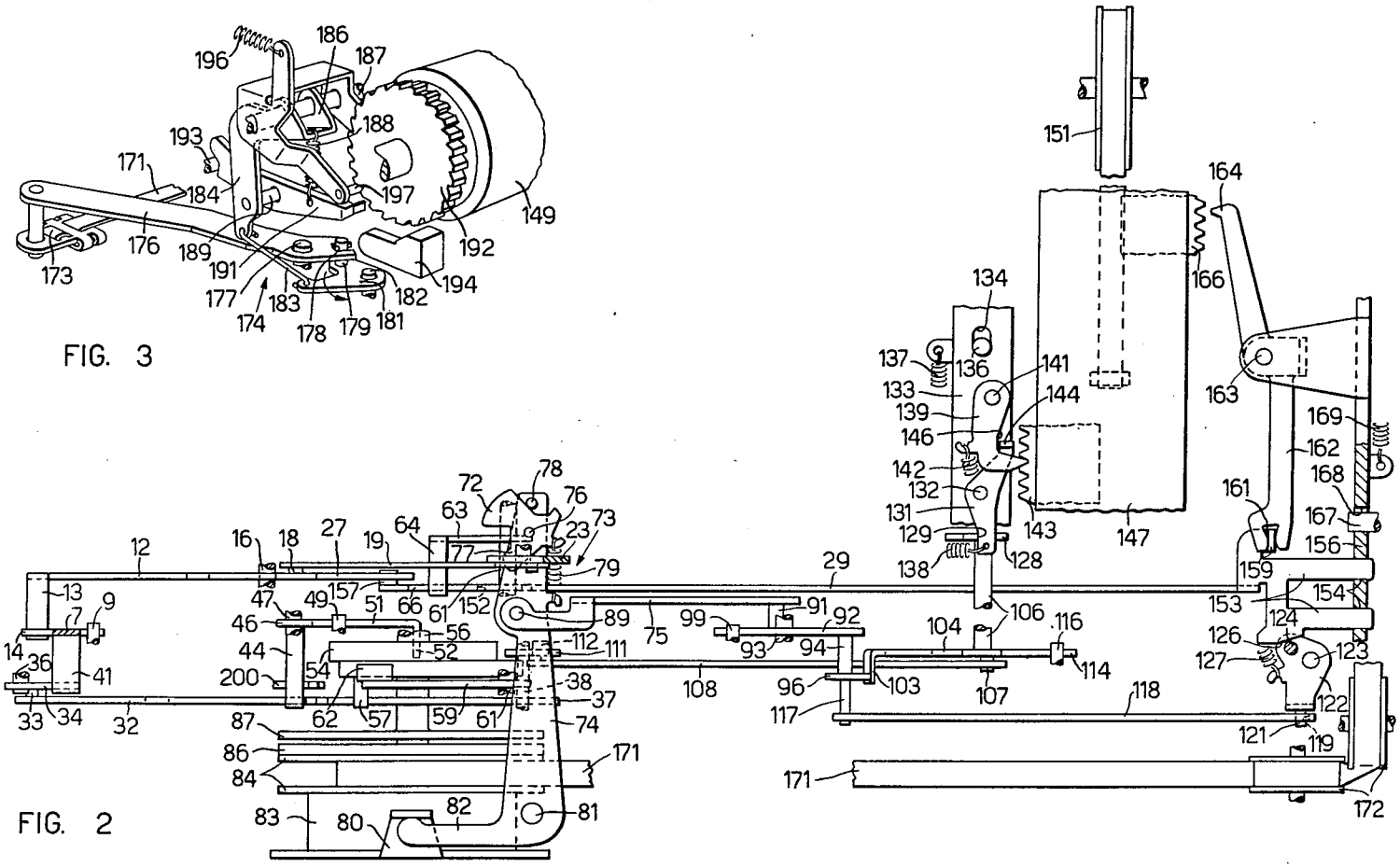
FIG. 2 is a partial plan view of the system.
FIG. 3 is a partial perspective view, on a larger scale, of the line-spacing mechanism of the system.

The disengaging device 104, rotating clockwise and acting through the connecting rod 108, causes the clutch control lever 111 (FIG. 1) to turn counter-clockwise and position the lug 112 in the path of the control tooth 53. After a rotation of the service clutch 54 for about 90°, the tooth 53 is arrested by the lug 112 and opens or disengages the clutch 54, as a result of which the cam 31 ceases to rotate. The pulley 84 (FIG. 2), on the other hand, continues to rotate, a further length of the band 171, guided by the pulleys 172, is wound on the pulley 84 and effects a line-spacing cycle by operation of the line-spacing mechanism 174 (FIG. 3). Thus, the lever 176, the bell-crank lever 181 and the tie rod 183 cause the bail 186 to turn counter-clockwise in opposition to the action of the spring 188. The arm 184 therefore brings the pawl 191 into engagement with a space of the ratchet wheel 192, causing it to rotate by an amount determined by the arrest of the pawl 191 on the block 194, thus effecting the line-spacing of the platen 149.

A further rotation of the pulley 84 (FIG. 2), keeping the line-spacing mechanism 174 (FIG. 3) in the working position, with the pawl 191 arrested on the block 194, now acts on the carriage 148 (FIG. 1) in opposition to the action of the escapement spring 151 (FIG. 2) and the carriage 148 carries along with it the escapement tooth 139, the movable support 133, the pawl member 162, the movable element 156 and the slider 29. The backward travel of the carriage 148 is smaller than the escapement step of the rack 143 and is determined by the extent of the slot 168. With this movement, the inclined surface 126 of the slider 29 causes the cam element 122 to turn further and, by means of the connecting rod 118, the cam element 122 turns the stepped lever 96 counter-clockwise. The shoulder 102 ceases its engagement with the lug 103 and allows the spring 113 to bring the disengaging device 104 back to rest or the inoperative state, arrested against the fixed stop 116. The connecting rod 108 then turns the clutch control lever 111 clockwise, so that the lug 112 releases the tooth 53 and allows the clutch 54 to close or engage again, bringing the cam 31 back into rotation. The escapement control lever 131, in turn, is brought back to the inoperative state by the spring 138 (FIG. 2) releasing the escapement tooth 139, which fully engages the space in the rack 143 owing to the action of the spring 142.

The cam 31 (FIG. 1), by means of its descending profile, now allows the spring 67 to cause the lever 63 to turn counter-clockwise. The inclined rear edge 71 then releases the cam device 72, which allows the spring 97 to shift the connecting rod 75 forward, rotating the lever 74 (FIG. 2) counter-clockwise until the lever 92 (FIG. 1) is arrested against the fixed stop 99. The control lever 80 of the friction clutch 83 (FIG. 2) produces the disengagement of the ring 86 from the disc 87, so that the rotation of the pulley 84 and the backward shifting of the carriage 148 (FIG. 1) cease. At the same time, by means of the lug 64, the lever 63 draws the arm 66 of the slider 29 forward, bringing this back to the inoperative state in opposition to the action of the corresponding spring 158, the pawl member 162 ceases its engagement with the rack 166 and the spring 127 (FIG. 2) causes the cam element 122 no longer retained by the inclined surface 126 to turn clockwise and shift the connecting rod 118 forward until the stepped lever 96 (FIG. 1) is arrested against the lug 103. The spring 169 (FIG. 2) brings the movable element 156 back to the inoperative state, arrested with the end of the slot 168 against the fixed pin 167, and the escapement spring 151 brings the carriage 148 (FIG. 1) back forward to the left until the movable support 133 (FIG. 2) of the escapement tooth 139 is arrested agains the end of the slot 134. Under these conditions, the spring 188 (FIG. 3) brings the line-spacing mechanism 174 back to the inoperative state. Since the lug 52 has remained in the path of the tooth 53 (FIG. 1), after the cam 31 has rotated through 360°, the clutch 54 is arrested by the action of the tooth 53 against the lug 52 even if the operator has kept the key 6 depressed. When the pressure on the key 6 ceases, the springs 8, 11, 26 and 79 (FIG. 2) bring the respective lever systems back to the inoperative state.

In a manner known, for example, from the U.S. Pat. No. 3,828,909, the normal stroke of the key 6 (FIG. 1) is defined by the arresting of a top edge 212 of an opening 211 of the shank 7 by a flexible strip 213 crossing the opening 211. The key 6 is able to perform an extra large stroke to obtain repeated line-spacing control cycles as long as the key 6 is in this position. This is possible because a greater pressure on key 6 causes the edge 212 to carry along with it resiliently the strip 213 and under these conditions the slider 32 is shifted forward by an amount greater then the normal amount, so that it engages by means of the high shoulder 43, instead of the shoulder 42, against the lug 44 of the stop element 46. The cycle is started and line-spacing control as hereinbefore described will be obtained, but since the straight portion 58 of the slider 32 is kept out of the path of the pin 57 of the cam 31, disengagement of the lug 44 from the shoulder 43 is not obtained and the lug 52 remains out of the path of the tooth 53. After rotating through 360°, the clutch 54 therefore remains engaged and the cycle then continues to be repeated as long as the key 6 is kept depressed.

Figure 4:
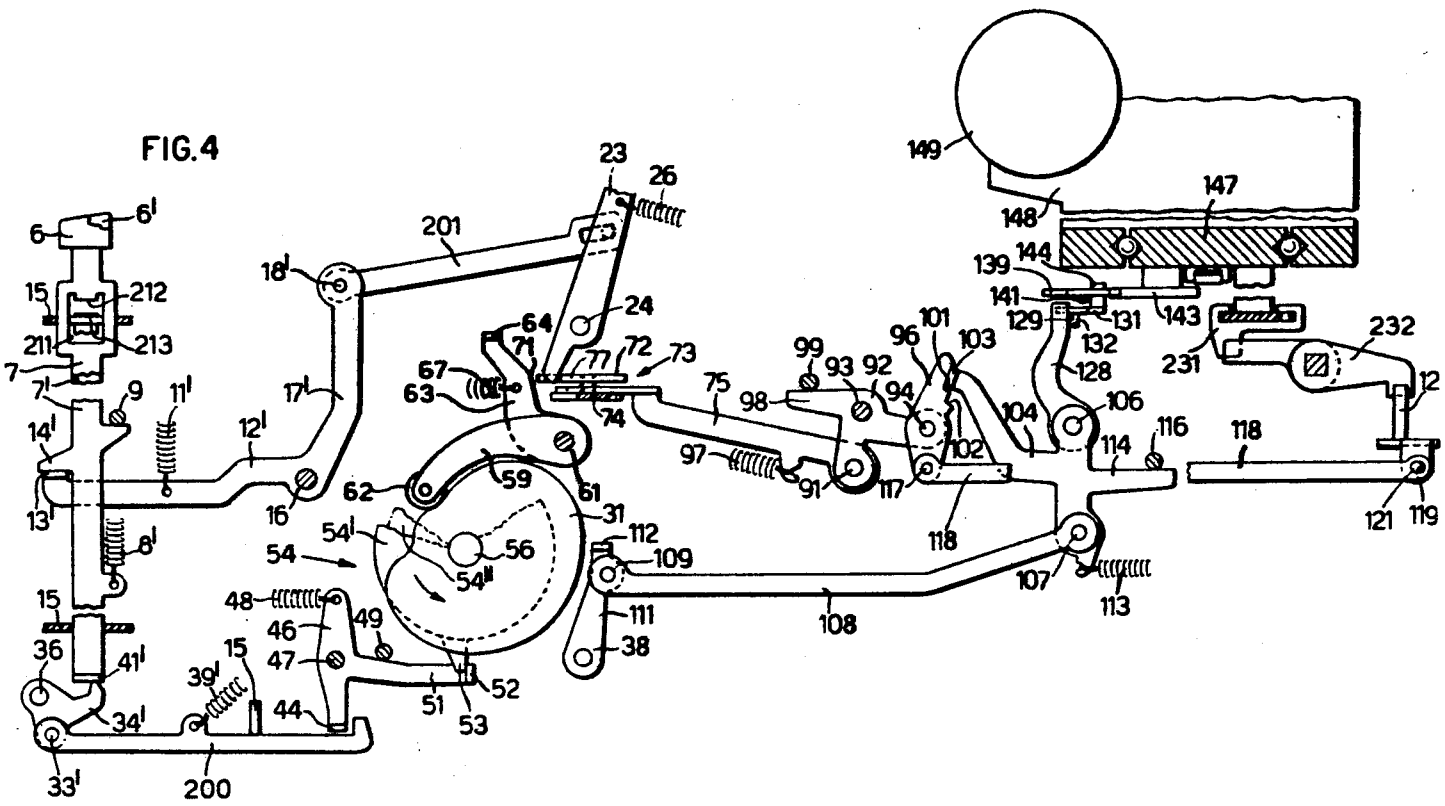
FIG. 4 is a partial longitudinal view of a printing office machine on which the system of the invention is used.

In order to add the special service of line-spacing without return to the beginning of the printing line in machines already provided with line-spacing with return to the beginning of the printing line, the system of the invention hereinbefore described adds in these machines a relatively small number of parts. More particularly, these machines are already provided with the two clutches, the service clutch 54 and the line spacing and carriage return clutch 83, with the corresponding actuating members and with the line-spacing mechanism of FIG. 3. In these machines, for performance of the function concerned, a return key 6' (FIG. 4), similar to the key 6, is depressed and actuates by a lug 41' of a shank 7', a lever 34', which operates through the medium of a slider 200 on the lever 46 for actuation of the clutch 54 and rotation of cam 31. A projection 14' of the shank 7' cooperates with a lug 13' of a release lever 12' rotatable on the spindle 16 and urged upwardly by a spring 11'. An arm 17' is connected through a tie rod 201 and a pin and slot connection with the lever 23. Upon depression of the key 6', the cam device 72, through lever 12, tie rod 201 and lever 23, is prearranged to turn counterclockwise (FIG. 2), disposing it in the path of the lever 63. Cam follower 59 and lever 63 (FIG. 1) turn clockwise; however, since the cam 27 has not been moved, the slider 29 cannot follow the movement of the lug 64 and the shoulder 101 of stopped lever 96 remains disposed below the lug 703. When the lever 63 engages the cam device 72, it causes the raising of stepped lever 96 and a complete extraction of the escapement tooth 139 from the rack 143 in the manner already described. On the other hand, it is clear that in this case the slider 29 and, therefore, the pawl member 162 are not actuated.

In the case of actuation of the return key 6', the pull of the band 171 effects the return travel of the carriage 148 on completion of the actuation of the line spacing mechanism 174 and the arrest of the return travel of the carriage 148 to the right after the actuation of the clutch 83 (FIG. 2) takes place where a left-hand margin stop 231 (FIG. 4) acts on the pin 124 of the cam element 122 through a counterstop 232, in the manner described in the U.S. Pat. No. 3,338,368. The cam element 122 (FIG. 2) rotates counterclockwise, thus providing for reengaging the clutch 54 and for causing the friction clutch 83 to disengage again, arresting the carriage 148 in the manner already described.

While preferred embodiments of the invention have been shown by way of example in the drawing, it will be understood that the invention is in no way limited to these embodiments.

What is claimed is:

1. In a printing office machine of the type having a carriage, a controllable line spacing mechanism and a controllable carriage return mechanism for returning the carriage to the beginning of the printing line, comprising:

actuatable control means for enabling both the line spacing mechanism and the carriage return mechanism;

means for actuating said control means to effect both the line spacing and the return of the carriage to the beginning of the printing line;

manually actuatable stop means for preventing the movement of the carriage to override said carriage return mechanism; and means for manually actuating both the control means and the stop means to effect the line spacing of the carriage without the return of the carriage to the beginning of the printing line, wherein the forward shifting of the carriage is effected by an escapement tooth coacting with a first rack of the carriage and wherein said stop means includes a second rack disposed on the carriage and a detent configured to coact with the second rack, wherein said detent is disposed in correspondence with the printing point of the machine to enable line-spacing without carriage return to the beginning of the printing line from any position along the printing line, wherein said control means effects the line-spacing before the return of the carriage and wherein said stop means includes a movable support slidably disposed relative to said carriage and shifted together therewith for disenabling the carriage return mechanism after the enabling of the line spacing mechanism, and wherein said detent is mounted on the movable support and the travel of the support is less than or equal to the escapement step of the first rack.

2. In a printing office machine according to claim 1, further comprising a service clutch actuated cyclically for controlling the carriage return mechanism and means for temporarily arresting the service clutch in an intermediate position during the operation of the carriage return mechanism including a clutch control lever, and wherein the stop means includes means actuated by the service clutch for locking the carriage to cause the movable support to act on the clutch control lever to complete the cycle of the service clutch to deactivate the stop means after actuation of the line spacing mechanism with the carriage substantially stationary.

3. In a printing office machine according to claim 2, wherein said carriage return mechanism comprises a carriage return clutch, a carriage-pulling band connected to the carriage return clutch and to the line spacing mechanism and wherein the carriage return clutch is actuated by the service clutch when the service clutch is arrested in the intermediate position wherein the detent engages the second rack and the movable support operates on the clutch control lever of the service clutch for withdrawal of the detent and arrest of the carriage return mechanism.

4. In a printing office machine according to claim 3, wherein the stop means include a control slider, a spring urging said control slider from an inoperative position toward an operative position causing the cooperation of said detent means with said second rack and a cam fixed to the service clutch and wherein said means for manually actuating both the control means and the stop means comprises a hook element movable from a first position arresting said control slider in said inoperative position, against the urging of said spring to a second position releasing said control slider, said cam causing the return of said control slider from said operative position to said inoperative position upon completion of the cycle of the service clutch after the temporary arresting thereof in said intermediate position.

5. In a printing office machine according to claim 4, wherein said carriage return mechanism further comprises an escapement control lever for disengaging the escapement tooth during the return movement of the carriage and an escapement spring and wherein a part of the escapement control lever operates on the escapement tooth to partially disengage the escapement tooth from the first rack when the detent is in engagement with the second rack, thereby enabling the escapement spring of the carriage to bring the carriage back into the original position, arrested against the escapement tooth.

6. In a printing office machine according to claim 5, wherein said means for manually actuating both the control means and the stop means comprises a service clutch control key shiftable into a first position to effect a working cycle and into a second position to effect a repetitive cycle, and wherein the key effects the positioning of the hook element, said control means comprising a stop element and another slider having two shoulders configured to cooperate with the stop element, and wherein the cam is fixed to the service clutch and has a pin configured to cooperate with said another slider to disengage the first of the shoulders from the stop element when the key is in the first position, so that the stop element can disengage the service clutch after a working cycle, and when the key is in the second position the second shoulder is engaged with the stop element and said another slider is positioned to be out of the path of the pin, whereby the service clutch remains engaged and the control means continuously actuates the line spacing mechanism as long as the key remains in the second position.

* * * * *